US005111493A

United States Patent [19]

Siedband

[11] Patent Number: 5,111,493

[45] Date of Patent: May 5, 1992

[54] PORTABLE X-RAY SYSTEM WITH CERAMIC TUBE

[75] Inventor: Melvin P. Siedband, Madison, Wis.

[73] Assignee: Wisconsin Alumni Research Foundation, Madison, Wis.

[21] Appl. No.: 607,603

[22] Filed: Oct. 31, 1990

Related U.S. Application Data

[62] Division of Ser. No. 276,152, Nov. 25, 1988, abandoned.

[51] Int. Cl.[5] ..... H05G 1/24

[52] U.S. Cl. ..... 378/103; 378/102; 378/105; 378/112

[58] Field of Search ..... 378/109, 110, 102, 103, 378/105, 106, 112

[56] References Cited

U.S. PATENT DOCUMENTS

| | | | |
|---|---|---|---|
| 2,119,069 | 5/1938 | Bouwers | 378/201 |
| 3,383,584 | 5/1968 | Atherton . | |
| 3,585,491 | 6/1971 | Petersen . | |
| 3,733,540 | 5/1973 | Hawkins . | |
| 4,008,427 | 2/1977 | Johnson . | |
| 4,030,015 | 6/1977 | Herko et al. . | |
| 4,034,280 | 7/1977 | Cronin et al. . | |
| 4,039,811 | 8/1977 | Ennslin et al. . | |
| 4,079,265 | 3/1978 | Woodburn | 378/103 |
| 4,104,531 | 8/1978 | Weiss . | |
| 4,150,423 | 4/1979 | Boschert . | |
| 4,186,329 | 1/1980 | Fairbain . | |
| 4,258,309 | 3/1981 | Ohsaka et al. . | |
| 4,259,581 | 3/1981 | Csontos et al. . | |
| 4,307,440 | 12/1981 | Inoue et al. . | |
| 4,350,891 | 9/1982 | Wuerflein . | |
| 4,350,948 | 9/1982 | Meroni . | |
| 4,378,501 | 3/1983 | Cowell . | |
| 4,439,868 | 3/1984 | Makino et al. . | |
| 4,450,577 | 5/1984 | Sato et al. | 378/110 |
| 4,481,461 | 11/1984 | Hiramatsu et al. . | |
| 4,553,255 | 11/1985 | Kanerva | 378/110 |
| 4,577,340 | 3/1986 | Carlson et al. | 378/125 |
| 4,625,324 | 11/1986 | Blaskis et al. | 378/130 |
| 4,694,480 | 9/1987 | Skillicorn | 378/110 |
| 4,856,036 | 8/1989 | Malcolm et al. | 378/102 |

FOREIGN PATENT DOCUMENTS 879753 12/1942 France .

OTHER PUBLICATIONS

*Philips Electronic Instruments* product information illustrating MCN 160, MCN 161, 160 kV Beryllium Window Tubes.

*Comet ceramic tube CIR*-100/0, 5/15° product drawing for Picker Lighthouse.

*Magnaflux Testing Systems*, Model MX15-10/30 Dual Focus Tube Head product description sheet.

*Primary Examiner*—Craig E. Church

*Attorney, Agent, or Firm*—Foley & Lardner

[57] ABSTRACT

A small, hand held X-ray machine is constructed to be readily portable, including a portable power supply, yet is sufficiently powerful to take an X-ray of a human patient. The X-ray machine includes a ceramic X-ray tube which is resistant to shocks and vibrations, structurally strong, as well as light weight, further contributing to the convenient portability of the X-ray machine.

18 Claims, 3 Drawing Sheets

PORTABLE X-RAY SYSTEM WITH CERAMIC TUBE

This invention was made with U.S. government support awarded by the U.S. Army Medical Research and Development Command, Grant No.: DAMD17-86C-6039. The U.S. government has certain rights in this invention.

This is a division of application Ser. No 07/276,152 filed Nov. 25, 1988, abandoned.

BACKGROUND OF INVENTION

X-ray technology has made many recent advances, particularly in the more sophisticated systems wherein large units are provided for taking X-rays of the object whether it be a human patient, or an industrial part that must be examined. Presently, there is a need for a small handheld X-ray unit with a self-contained power source for use in emergency field care, such as at the scene of a common accident. Since the accident scene may be chaotic, the need for a machine of considerable simplicity is required. For such units, exposure control should be simple and automatic, similar to an aim-and-shoot camera. More specifically, for such units it is desirable to turn the unit On, insert the receptor film, verify that the "Ready" light in On, and then aim and shoot.

SUMMARY OF THE INVENTION

According to the need expressed above, the present invention provides a small, handheld X-ray system machine that is readily portable, that is efficient, that includes a ceramic X-ray tube, that includes a portable power supply, and that is sufficiently powerful to take an X-ray of a human patient and provide various high performance features.

BRIEF DESCRIPTION OF THE DRAWINGS

Novel features and advantages of the present invention in addition to those mentioned above will become apparent to those skilled in the art from a reading of the following detailed description in conjunction with the accompanying drawing wherein.

DESCRIPTION OF THE INVENTION

Figure 1:
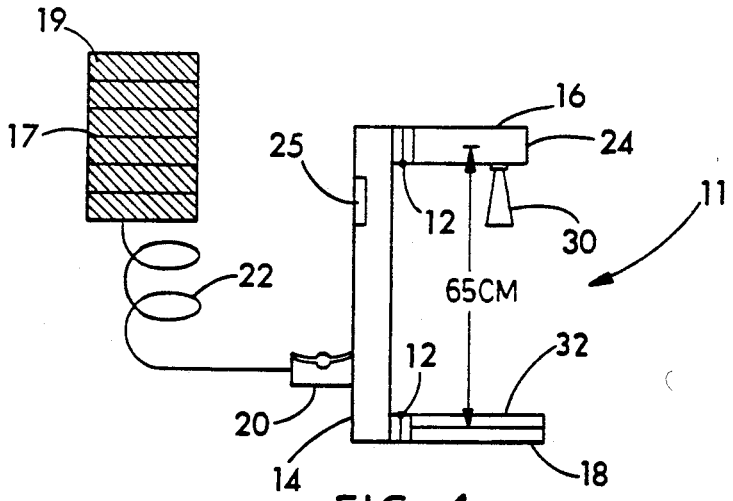
FIG. 1 is a sketch showing a side view of the inventive handheld X-ray unit.

FIG. 1 shows the inventive hand held X-ray unit 11, formed essentially in a C-shaped configuration. As mentioned above it is small, compact, and readily portable. The X-ray unit 11 includes a vertical post 14, an upper arm 16 and a lower arm 18. A grip handle 20 is centrally attached to post 14. A control panel (see FIG. 2) is also mounted on post 14. A power cable 22 connects via handle 20 to a power pack 17 which comprises, in one embodiment, NiCad rechargeable batteries 19 connected in parallel for charging, and connected in series for operation, as will be discussed. In the embodiment of FIG. 1, arms 16 and 18 are hingeable as at 12 for nesting or folding onto post 14.

Figure 2:
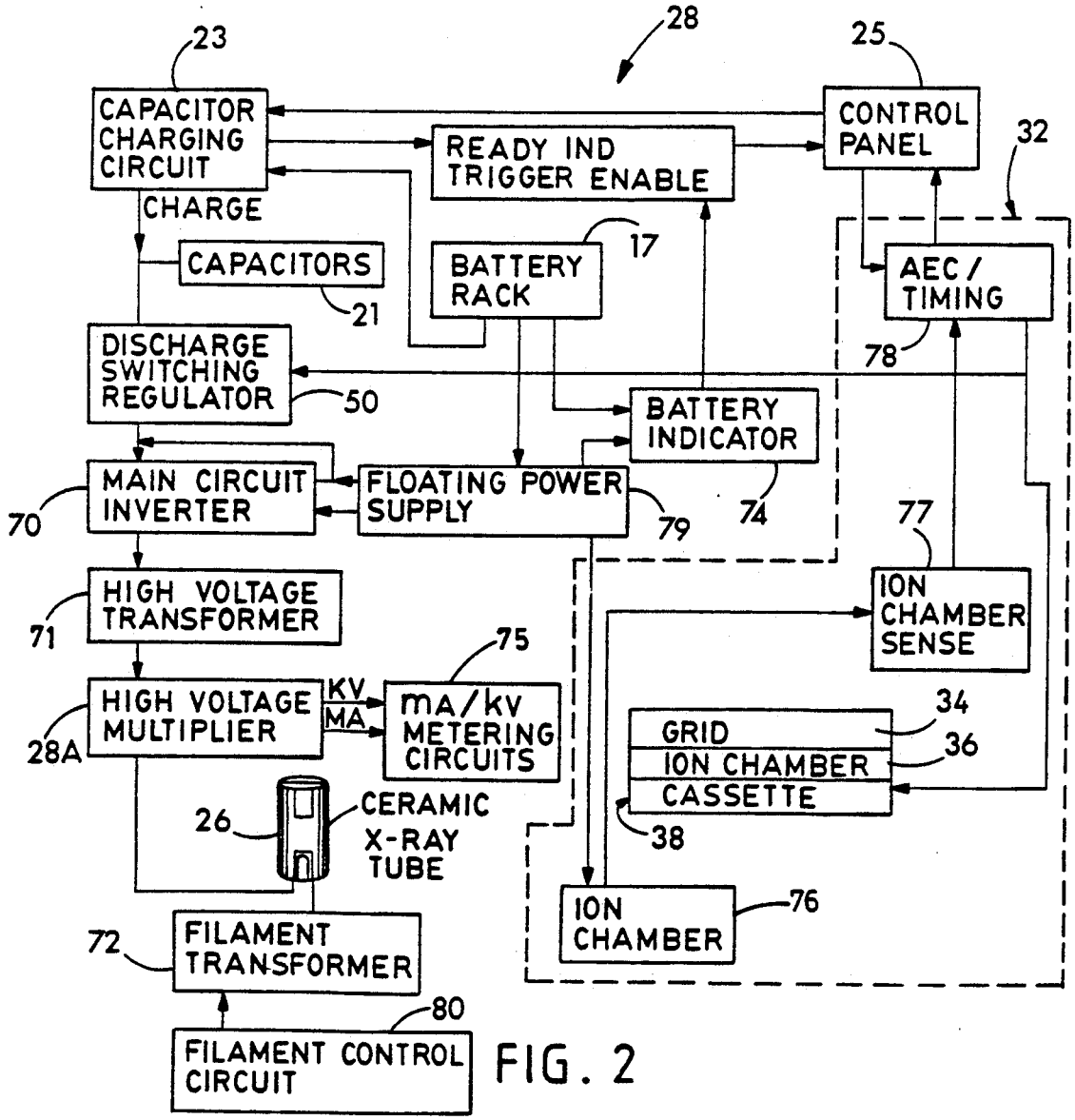
FIG. 2 is a block diagram of the circuitry of the handheld X-ray unit of FIG. 1.

Refer now also to FIG. 2. An X-ray tube head 24 is mounted in the upper arm 16. Tube head 24 consists of an X-ray tube 26, the high voltage generation circuits 28, and a beam limiting cone 30. A receptor assembly 32 is mounted in the lower arm 18 and includes a conventional X-ray grid, a film cassette holder, and a sensor unit.

The power pack 17 comprises the Nicad batteries 19, energy storing electrolytic capacitors 21 and a capacitor charging circuit 23. The embodiment shown uses three 0.01f electrolytic capacitors which are changed to 305 volts. Ten 1.2 V NiCad calls are arranged in two banks of five cells each. The banks are in series for use and in parallel for charging with the parallel/series connection being made at the cable 22 connection to the power pack 17. When the cable 22 is removed, a charging cable (not shown) can be connected to charge the batteries. The charging cable can be fed from a variety of charging circuits ranging from a series resistor/-cigarette lighter plug such as used on a passenger vehicle, or a small appliance charger, or a regulated fast-charger device.

The battery pack 17 is capable of providing power for up to fifty exposures and can be recharged from almost any external source. Charging the energy storage capacitors 21 for the first exposure, requires less than three minutes. Additional exposures can be taken at 30 second intervals.

A battery indicator circuit 74 indicates the status of the battery voltage to the user so as prevent exposures when the batteries 19 voltage is below a set threshold.

A capacitor discharge switching circuit 50 controls the selective discharge of the energy storing capacitors 21. The capacitors 21 provide the energy needed to power the X-ray tube 26 as will be described.

The principal of operation is analogous to a photographic flash gun in that energy is accumulated in the electrolytic capacitors 21 and is selectively discharged to power the X-ray exposure. The energy storage capacitor charging circuit 23, of suitable known design, comprises a switching converter which supplies 400 volt charging spikes to the storage capacitors 21. (In FIG. 3, the storage capacitors are indicated as a single capacitor 21 for purposes of simplicity in drawing.) In operation, the voltage on the energy storage capacitors 21 diminishes exponentially as energy is withdrawn; however, as will be described, the capacitor switching regulator discharge circuit 50 (FIGS. 2 and 3) is a switching regulator which provides a constant voltage output of 65 to 160 V, depending on the desired X-ray tube voltage.

Figure 3:
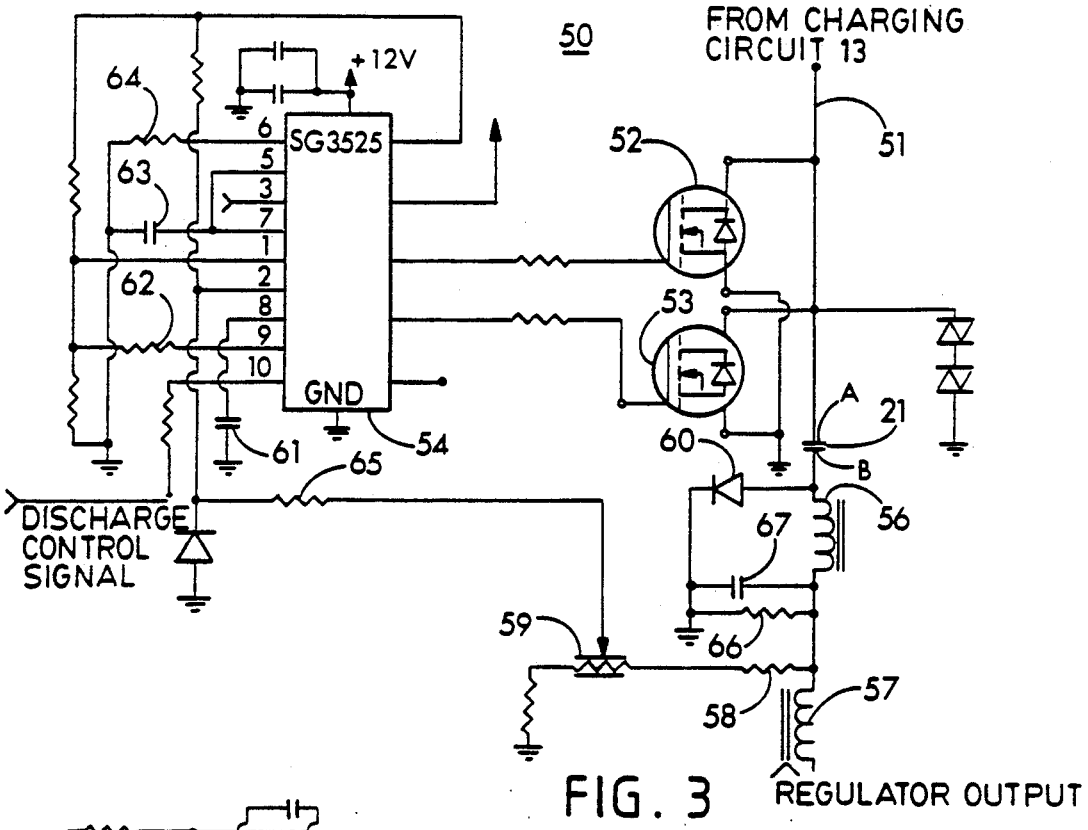
Fig. 3 is a circuit diagram of the capacitor discharge switching regulator of FIG. 2.

The switching regulator scheme of FIG. 3 is more efficient than a linear regulator, but normally has the characteristic of generating radio frequency interference. Attention must thus be given to power supply bypassing, grounding, shielding as will now be described. In conventional step down converter shemes, a P-channel FET (Field Effect Transistor) or a PNP bipolar transistor is used as the switch between the DC input and the associated inductor. P-channel FETs are not available which have sufficient current and voltage ratings for the present application. Accordingly, the invention incorporates N-channel MOSFET's with the drive circuitry, to permit switching to ground in order to reduce interference and noise.

Refer now to FIG. 3 in more detail. Capacitor 21 has one terminal or plate A connected to the charging circuit and its other terminal or plate B connected to the upper terminal of inductor 56. The lower terminal of inductor 56 is connected to the upper terminal of a toroid 57. Also the lower terminal B of capacitor 21 is connected through diode 60 to ground. The output terminal of toroid 57 provides a regulated output. As shown in FIG. 3. The DC input source, that is the storage capacitor(s) 21, are positioned after MOSFET switches 52 and 53 rather than before the switches. The negative terminal of the storage capacitor(s) 21 are no longer tied to ground. This results in the DC output pulse being negative with respect to ground.

A pulse width modulation integrated circuit chip 54, which is of conventional design, alternately gates the MOSFET switches 52 and 53 On and Off. Each of the MOSFET switches 52 and 53 switches at 10 kHz for an effective regulator switching frequency of 20 kHz. By alternately firing the MOSFETs 52 and 53, each MOSFET carries the load current for half the length of time as compared to single MOSFET operating at 20 kz; thus reliability is increased. When either MOSFET 52 and 53 switches ON, energy is transferred to the load. When the MOSFET switches are Off, energy stored in the inductor 56 is fed to the load.

The junction of inductor 56 and toroid 57 is connected through resistor 58, potentiometer 59 and resistor 65 as an input to the pulse modulator chip 54. Thus, resistor 58, potentiometer 59 and resistor 65 close the loop between the variable output load voltage, and the pulse modulator 54.

In the embodiment shown, the on-time of the gating pulses is varied to regulate the output voltage from −65 to −160 V. The voltage across the X-ray tube is proportional to the regulator output and is adjusted by the potentiometer 59.

The resistor 66 connected across the filter capacitor 67 holds the output near ground when the capacitor charging circuit 23 and capacitor discharge switching regulator 50 are idle. The resistor 66 and filter capacitor 67 prevent the output from drifting and will assure the charging circuit 23 is turned off when the storage capacitor 21 voltage level has reached the desired full charge level. The inductor 56 stores energy between switching cycles of the FET's 52 and 53. The inductor 57 is a current limiting device for the saturated power inverter which feeds the high voltage supply. Because of the distributed capacity of the secondary winding of the high voltage transformer, a portion of the inverter cycle is spent charging/discharging that stored charge. An alternative configuration of the circuit combines the functions of inductors 56 and 57 by obviating capcitor 67 and decoupling potentiometer 59.

The outputs of the pulse modulator chip 54 are low until the input pin (pin 10 in the embodiment shown) is pulled low from its normally high state by a discharge control signal. When the input pin is pulled low by the discharge control signal an exposure is taken for the duration that the input pin 10 is held low. The capacitor 61 connected to pin 8 controls the fall time of the negative output pulse and, to some degree, the leading edge overshoot. The resistor 62 connected between input pins 1 and 9 of pulse modulator chip 54 determines the gain provided by chip 54. The RC networks 63 and 64 determine the switching frequency of the chip 54.

In operation, the capacitor(s) 21 are selectively discharged to produce a short, powerful exposure. The voltage from capacitor(s) 21 is applied to a saturated high frequency (25 kHz) power invertor 70 which feeds the high voltage transformer 71. A voltage multiplier 28 converts the high frequency energy from transformer 71 to a constant potential to operate the X-ray tube 26. The tube 26 filament transformer 72 is controlled by filament control circuit 80 also operates at a high frequency to permit it to be made very small.

As mentioned above, capacitor discharge energy systems normally have the problem of a diminishing voltage on the capacitor during discharge. Importantly, switching regulator circuit 50 provides a voltage to the X-ray tube 26 which is constant during discharge, such that up to 70% of the energy stored in capacitors 21 can be used for the production of X-rays. The X-ray power level of the inventive system is adequate for a motion-stopping image of the chest and capable of penetrating an average abdomen.

The negative DC voltage pulse from the discharge regulator is fed to the main output inverter 70. As mentioned above, the inverter 70 converts the DC voltage to an AC voltage so that the voltage can be stepped up by the high voltage transformer 71 and voltage multiplier 28.

The X-ray tube anode potential is set by control of the output voltage of the discharge regulator 50. The combination of the switching regulator 50 and the saturated inverter 70 keeps the circuit simple and efficient since no variable resistance elements are used.

The high voltage multiplier circuit 28 receives the output of the high voltage transformer 71 and steps it up to 40–90 kV across the X-ray tube.

An ion chamber 76 sense circuit provides an ion sense input signal to the ion chamber sense circuit 77 which in turn provides a signal to an exposure control/timing circuit 78. During an exposure the ion sense signal proportionally reflects the number of ions created in the ion chamber 76. When enough ions for the proper exposure have been collected a signal is provided to terminate the exposure. The Automatic Exposure control (AEC)-/timing circuit 78 receives a signal from the ion chamber. The AEC circuit determines the timing mode, and times the X-ray exposure in the selected timing mode. In the AEC mode, the length of the exposure is determined by the ion chamber 76 and ion chamber sense circuit 77.

The floating power supply circuit 79 provides the floating supply operating voltages that are required such as by the inverter circuit 70, and to bias the ion chamber 76.

Figure 4:
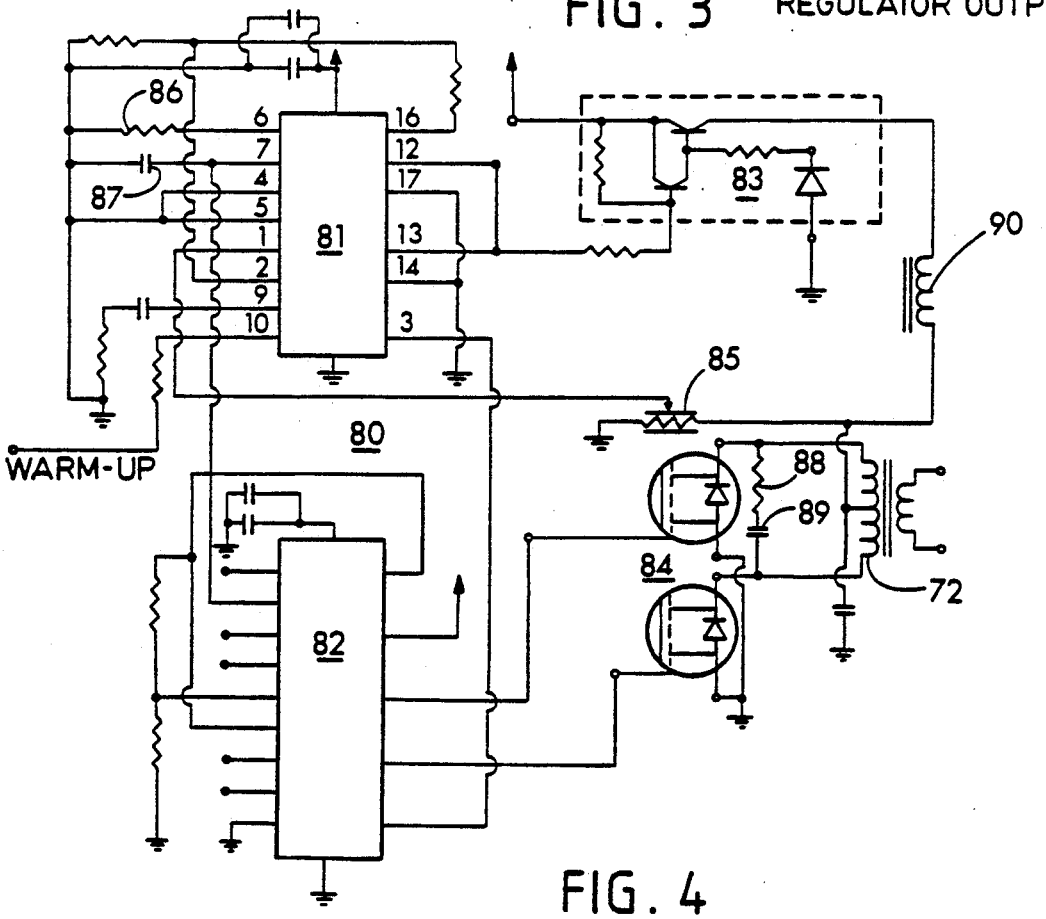
FIG. 4 is a circuit diagram of the filament control circuit of FIG. 3.

The filament control circuit 80, shown in FIG. 4 consists of a pulse width modulator 81, a pulse width modulator 82, a switching regulator 83, and two switching FETs 84. The circuit 80 provides a tightly regulated current needed for the filament of the X-ray tube 26. The filament control circuit 80 in essence comprises as its major subcomponents, a voltage regulator including pulse width modulator 81 and switching regulator 83, and a saturated inverter comprising modulator 82 and FETs 84.

The voltage regulator portion comprising units 81 and 83 of the circuit 80 provides an adjustable and extremely stable voltage to the saturated inverter comprising units 82 and 84. The saturated inverter (82, 84) converts the DC regulated voltage to a 20 kHz square wave which is then fed to the filament transformer 72. The transformer 72 provides isolation between the control circuitry and the filament as well as lowering the average DC voltage level supplied to the filament of the X-ray tube 26.

Modulator 81 provides a pulse width modulated signal which is used to gate the switching regulator 83 which comprises an integrated package consisting of a PNP power transistor and a clamping diode. When the regulator 83 is gated ON, energy is transferred to the load. When the regulator 83 is switched OFF, energy stored in the inducter 90 is fed to the load. The DC regulator voltage is monitored and adjusted via the feedback potentiometer 85 connected to the inverting input of the modulator 81. The DC voltage is proportional to filament current, therefore, the potentiometer 85 is used to set the filament current.

The internal output transistors of the modulator (IC) 81 are connected in parallel for single-ended output operation. With the outputs parallel, an effective duty cycle of 0–90% is attained and the frequency of the internal oscillator is the frequency of the output. The resistor 86 and capacitor 87 provide for an internal oscillator frequency of 40 kHz. A warmup signal is connected to the shutdown input (pin 10) of the modulator 81 so that the circuit can be switched on just prior to an exposure.

As mentioned, the saturated inverter consists of the modulator 82, two FETs 84, and the filament transformer 72. The modulator 82 is synchronized to the oscillator 81 and is configured for push-pull operation. In this configuration the two outputs are alternately switched with 45% duty cycles and an overall frequency of one-half the oscillator frequency; that is, 20 kHz. The filament transformer 72 steps the regulator voltage down to the required 24 V. The snubber across the leads of the transformer comprising resistor 88 and capacitor 89 are needed to suppress the switching spikes on the outputs of the FETs 84.

An ion chamber 36 of known design is snadwiched between an X-ray grid 34 and an X-ray receptor, film cassette or Polaroid cassette 38. Ion chamber 36 is used by the AEC circuitry in order to automatically time an exposure. While a variety of image receptors may be used a commercially available positive print type film has been found to be quite suitable. X-rays thus go through the patient and the grid, then pass through the ion chamber, and finally strike the receptor.

Conventional ready circuits provide a signal which is used to enable an X-ray exposure and to indicate that an exposure can be taken. A metering circuit 75 provides a signal to determine whether or not enough energy is available to make an exposure.

Figure 5:
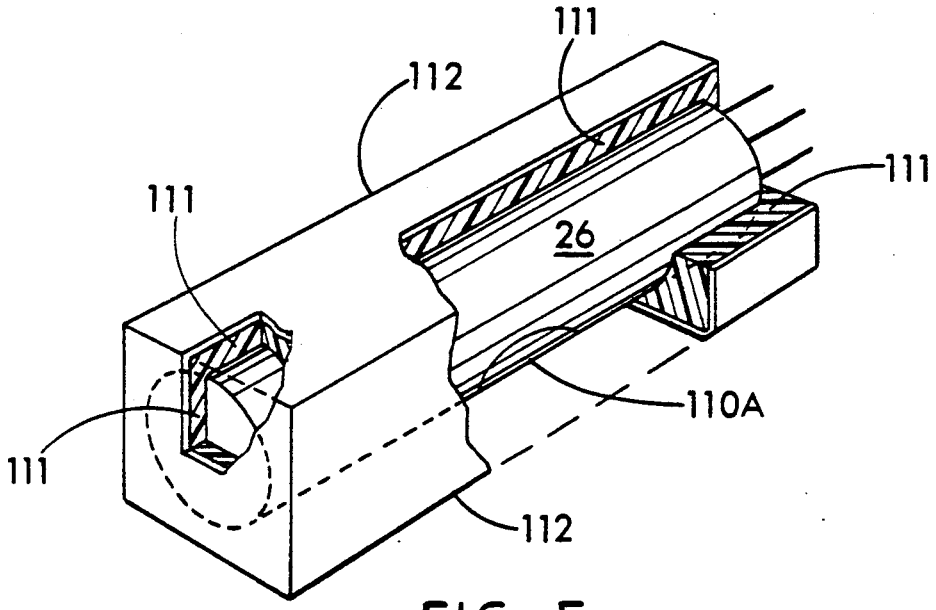
FIG. 5 is a relatively enlarged perspective view of the ceramic tube of FIG. 2; and, FIG. 6 is a side view, partially in section of the ceramic tube of FIGS. 2 and 5.
Figure 6:
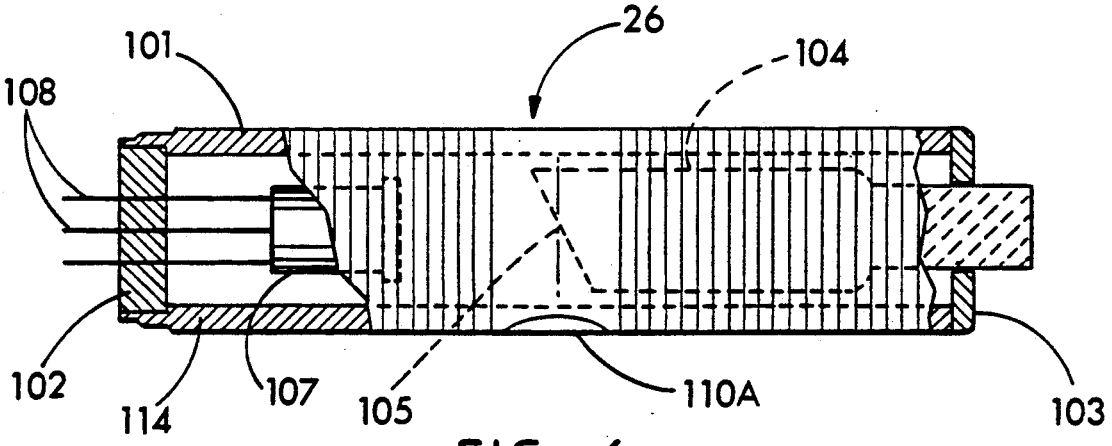

An important part of the invention, namely, the ceramic tube 26 will now be described with reference to FIGS. 5 and 6. Prior art X-ray tubes are usually made of glass and are used within oil-filled enclosures. The prior art enclosures are lined with lead so that the X-ray beam can exit only from a window of the enclosure. Prior art X-ray tubes which use glass envelopes cannot withstand mechanical shock or vibration.

The ceramic X-ray tube 26 of the invention comprises a tungsten oxide based ceramic cylinder 101 as the body of the tube. Importantly, the ceramic material serves as the structural body of the tube, and also as an inherent X-ray shield. The cylinder 101 is placed in a housing enclosure 112 filled with a silicone gell 111 which bonds to the outer surface of cylinder 101. Silicone gels 111 can bond to the ceramic material but do not bond to glass without the addition of special primers or adhesion compounds. Metallic end caps 102 and 103 are brazed at the ends of the cylinder 101. The X-ray tube 26 effects a reduction of size and weight of conventional X-ray tubes, and provides an improvement of the shielding characteristics.

The anode 104 of the X-ray tube includes a tungsten target 105 plated on a solid bronze or copper body, which, in turn, is mounted on end cap 103 of tube 26. The cathode 107 of tube 26 is mounted by rigid leads 108 to end cap 102.

Tungsten oxide or other exotic metal oxides which are stable at high firing temperatures, may be added to the ceramic material of tube 26. The resulting ceramic compound is vacuum-tight and of excellent insulating properties. A portion of the cylinder, the exit window, is made of a compatible ceramic, but without the tungsten oxide. The use of a tungsten oxide based cylinder means that the tube is self-shielded and obviates or reduces the amount of lead or litharge X-ray beam shielding. X-ray tubes of smaller size and reduced weight are therefore possible. The wall thickness indicated at 114 of the cylinder 101 can be selected to provide the desired X-ray shielding to the object. Alternatively, and as shown in FIG. 6, the ceramic cylinder 101 can be constructed to have a desired extra thickness to provide the necessary shielding. Also a beryillium window 110A can be formed for minimal filteration of the X-rays.

Also, the use of brazed ceramic tube configuration makes it possible to build tubes of exceptional resistance to shock and vibration.

The handheld X-ray machine of FIG. 1 performs as well as more powerful single phase conventional X-ray machines. There are two reasons for this: the reduced focus to film distance requires half the energy for penetration; and, the constant potential on the tube 26 increases the actual output in MR/mAs (milliroentgens/-milliampere second). The tube current of 35 mA for the handheld machine is equivalent to about 150 mA of a single phase generator. The constant potential circuit means that energy is used more efficiently by the X-ray tube.

Referring still to FIG. 1 for operator and patient safety, a conventional X-ray tube must be shielded with a litharge (lead oxide) or equivalent cylindrical shield, and the radiation from the open ends of the cylinder must be blocked by means of lead sheet within the housing or equivalent structure close to the tube. The use of the novel X-ray tube fabricated with a ceramic containing oxides of high atomic number elements eliminates the need for the cylindrical shield and permits the design of smaller tube heads.

The stainless steel collimating cone 30 restricts the X-ray field to an area no larger than the receptor assembly 32 which is backed with lead shielding. The exposure switch on the conrol panel 25 is located in a position that reduces the operator exposure to a low value of backscattered radiation. A remote control exposure switch not shown, may be provided for even greater protection for the operator.

While the invention has been particularly shown and described with reference to a preferred embodiment thereof, it will be understood by those skilled in the art that various changes in form and details may be made therein without departing from the spirit and scope of the invention.

I claim:

1. X-ray apparatus comprising:

(a) an energy source for providing a DC voltage;

(b) a storage capacitor;

(c) means for recharging the capacitor from the energy source;

(d) power supply means, connected to the capacitor, for providing a regulated output voltage, including an inductor connected between the storage capacitor and the output of the power supply means, a controllable switch connected between the storage capacitor and ground on the other side of the capacitor from the inductor, a pulse-width modulator providing output pulses to control the controllable switch with the width of the pulses from the modulator modulated in accordance with an input signal to provide negative output pulses from the capacitor to the inductor, and means for providing an input to the pulse-width modulator to maintain the output voltage of the power supply means substantially constant as the capacitor voltage changes during an X-ray exposure;

(e) an X-ray tube having at least an anode and a cathode;

(f) means, receiving the output of the power supply means, for selectively providing a high voltage between the anode and cathode of the X-ray tube to drive the same.

2. An apparatus as in claim 1 wherein the energy source to charge said capacitor is a storage battery.

3. An apparatus as in claim 1 wherein the energy source to charge said capacitor is a power line of limited capacity.

4. The X-ray apparatus of claim 1 wherein the means for providing an input to the pulse-width modulator includes feedback means for feeding back the output of the power supply means to the input of the pulse width modulator.

5. The X-ray apparatus of claim 1 wherein the controllable switch comprises two FETs connected in parallel between the capacitor and ground and wherein the pulse-width modulator is connected to the gates of the two FETs to drive them alternatively on every other pulse of the pulse-width modulation so as to split the duty cycle for the pulse width modulation between the two FETs.

6. The X-ray apparatus of claim 1 including a capacitor and resistor connected in parallel between the output of the inductor and ground to filter the output voltage of the power supply means.

7. The X-ray apparatus of claim 1 including means for selecting the DC output voltage from the power supply means.

8. The X-ray apparatus of claim 1 wherein the means for providing an input to the pulse width modulator includes a potentiometer connected to the output of the power supply means and connected to the input of the pulse-width-modulator to provide feedback of the output voltage to the pulse width modulator with the desired DC output voltage level being set by the potentiometer.

9. The X-ray apparatus of claim 1 wherein the means receiving the output of the power supply means includes a saturated high frequency power inverter which provides its output to a high voltage transformer.

10. The X-ray apparatus of claim 1 including a diode connected on one side to the connection between the storage capacitor and the inductor and on the other side to ground to allow current charging the capacitor to flow to ground through the diode.

11. X-ray apparatus comprising:

(a) a battery providing a DC voltage;

(b) a storage capacitor;

(c) means for recharging the capacitor from the battery;

(d) power supply means, connected to the capacitor, for providing a regulated output voltage, including a controllable switch, an inductor connected between the capacitor and the output of the power supply means, the controllable switch connected between the capacitor and ground with the other side of the capacitor connected to the inductor to control the discharge of the capacitor through the inductor, a pulse-width modulator providing ouput pulses to control the controllable switch with the width of the pulses from the modulator modulated in accordance with an input signal, and feedback means for feeding back the output voltage from the output of the power supply means to the input of the pulse-width modulator to maintain the output voltage substantially constant as the capacitor voltage changes during an X-ray exposure;

(e) an X-ray tube having at least an anode and a cathode; and (f) means, receiving the output of the power supply means, for selectively providing a high voltage between the anode and cathode of the X-ray tube to drive the same.

12. The X-ray apparatus of claim 11 including a capacitor and resistor connected in parallel between the output of the inductor and ground to filter the output voltage of the power supply means.

13. The X-ray apparatus of claim 11 including means for selecting the DC output voltage from the power supply means.

14. The X-ray apparatus of claim 11 wherein the feedback means includes a potentiometer connected to the output of the power supply means and connected to the input of the pulse-width modulator to provide feedback of the output voltage to the pulse width modulator with the desired DC output voltage level being set by the potentiometer.

15. The X-ray apparatus of claim 11 wherein the means receiving the output of the power supply means includes a saturated high frequency power inverter which provides its output to a high voltage transformer.

16. The X-ray apparatus of claim 11 wherein the pulse-width modulator is connected to the controllable switch to drive the same in a pulse-width modulated fashion to provide negative output pulses from the capacitor to the inductor to regulate the output of the power supply means.

17. The X-ray apparatus of claim 16 wherein the controllable switch comprises two FETs connected in parallel between the capacitor and ground, and wherein the pulse-width modulator is connected to the gates of the two FETs to drive them alternatively on every other pulse of the pulse-width modulation so as to split the duty cycle for the pulse width modulation between the two FETs.

18. The X-ray apparatus of claim 16 including a diode connected on one side to the connection between the storage capacitor and the inductor and on the other side to ground to allow current charging the capacitor to flow to ground through the diode.

* * * * *